US005642917A

United States Patent [19]

Geiger

[11] Patent Number: 5,642,917

[45] Date of Patent: Jul. 1, 1997

[54] HIGHCHAIR/FEEDING CHAIR BOOSTER CUSHION

[76] Inventor: Debra Ann Geiger, Crestview Apts. Bldg. 3, Apt. 1B, 971 Hwy. 9 N., Parlin, N.J. 08859

[21] Appl. No.: 676,898

[22] Filed: Jul. 8, 1996

Related U.S. Application Data

[63] Continuation of Ser. No. 409,000, Mar. 23, 1995, abandoned.

[51] Int. Cl.[6] ..... A47D 15/00

[52] U.S. Cl. ..... 297/219.12; 297/228.12; 297/219.1; 297/250.1; 297/DIG. 6

[58] Field of Search ..... 297/228.12, 219.1, 297/219.12, 229, 250.1, 256.17, 464, 485, DIG. 6

[56] References Cited

U.S. PATENT DOCUMENTS

| | | | |
|---|---|---|---|
| 1,934,615 | 11/1933 | Selverstone | 297/229 |
| 3,857,120 | 12/1974 | Acker | 297/DIG. 6 X |
| 4,383,713 | 5/1983 | Roston | 297/DIG. 6 X |
| 4,824,169 | 4/1989 | Jarrell | 297/DIG. 6 X |
| 4,843,662 | 7/1989 | Handelman | 297/DIG. 6 X |
| 5,018,790 | 5/1991 | Jay | 297/DIG. 6 X |
| 5,076,264 | 12/1991 | Lonardo | 297/485 |
| 5,123,699 | 6/1992 | Warburton | 297/219.1 |

*Primary Examiner*—Peter R. Brown

[57] ABSTRACT

A device for use in sizing a highchair to a child. This device comprises a back, two side and bottom panel in lightweight form which is removably fastened for assembly/disassembly quickly and easily to a highchair/feeding chair. All the panels are interchangeable with the same panels in various widths for continuous proper fit as the child grows.

1 Claim, 2 Drawing Sheets

HIGHCHAIR/FEEDING CHAIR BOOSTER CUSHION

This is a continuation of U.S application Ser. No. 08/409,000, filed Mar. 23, 1995, now abandoned.

BACKGROUND OF THE INVENTION

1. Field of the Invention

The invention relates generally to a device for better sizing the highchair/feeding chair to each individual child.

2. Prior Art

Highchair/feeding chairs are used for feeding children for the first few years of life; a time when their growth is at its most rapid pace. The problem with current highchair/feeding chairs is that each model is one size fits all and that size is when the average child is in his/her final stage of using the highchair/feeding chair. Also, premature children tend to be even smaller in size then the average child which makes it even more difficult for them to fit into the highchair/feeding chair.

The sizing of the highchair/feeding chair to the child throughout this period of time is overcome by this invention.

SUMMARY OF THE INVENTION

The principle object of the present invention is to provide a device for use in sizing a highchair to a child for the purpose of fitting the child to the highchair.

It also is an object of the present invention to provide such a device which is of simple, inexpensive construction.

Another object is to provide such a device that is capable of decreasing in size as the child grows, a person can remove the panels individually as the child no longer needs them, i.e., sides, back or bottom. Also, a person will be able to interchange each of these panels for smaller widths of the same panel section if the child still needs the support of that section but not in that width to offer continuious fit as the child grows. In some cases, a child may need a larger panel section, this is also possible.

BRIEF DESCRIPTION ON THE DRAWINGS

The present invention will be more fully understood by references to the following detailed description thereof when read in conjunction with the attached drawings, and wherein.

DETAILED DESCRIPTION

Figure 1:
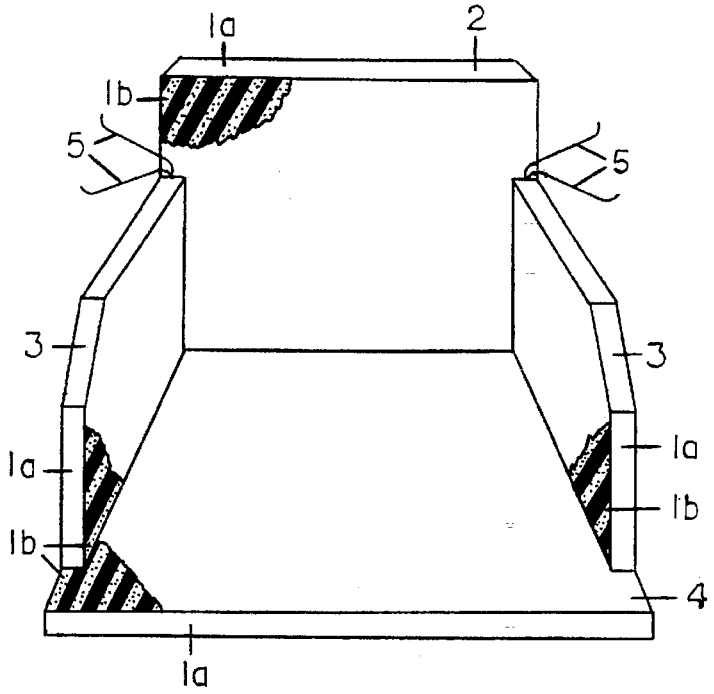
FIG. 1 is a front elevational view of the highchair/feeding chair booster cushion.
Figure 2:
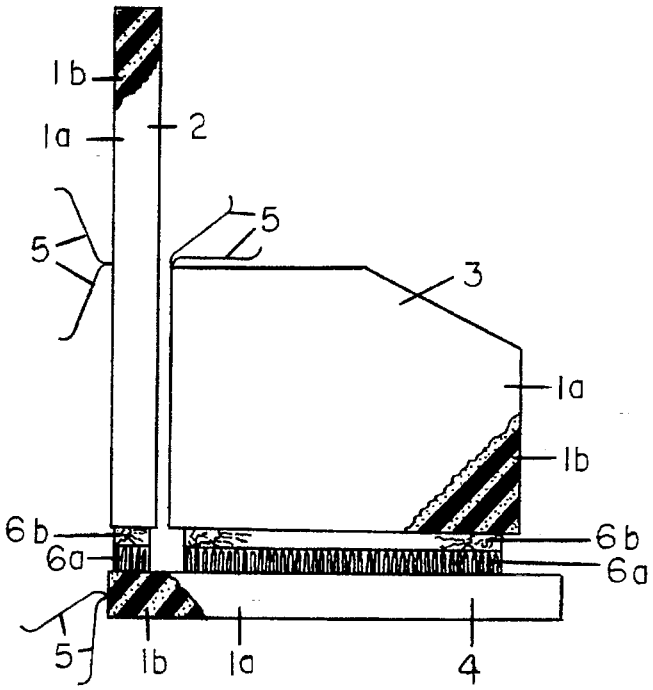
FIG. 2 is a side view thereof.
Figure 3:
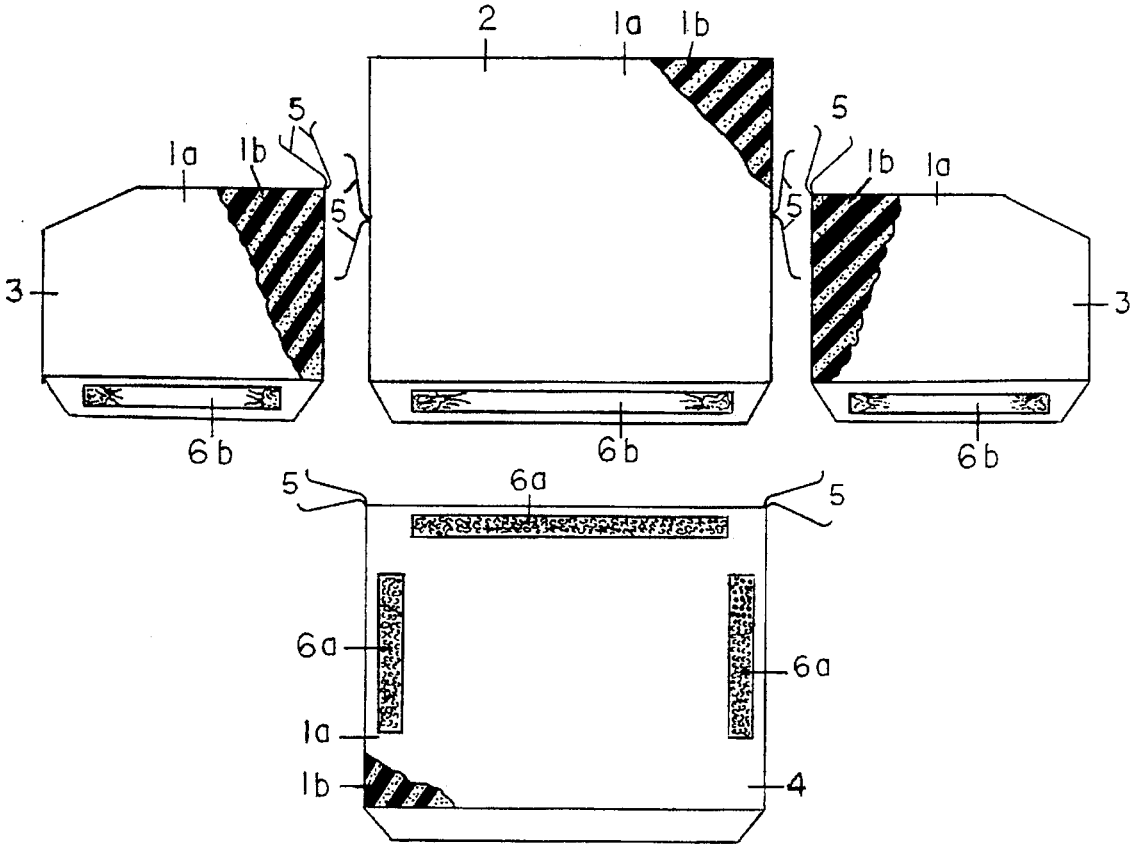
FIG. 3 is a front elevational view of the individual pieces laying flat thereof.

Referring to FIGS. 1, 2 and 3, an embodiment of the Highchair Booster Cushion Device is shown to be used exclusively in combination with a child's highchair. In this embodiment, the highchair/feeding chair booster cushion is removably fastened on the highchair/feeding chair by cording 5. Any means for attaching the cording may be used including snap fasteners or other means. The cording 5 can be attached to highchair booster cushion at any convenient location. In this embodiment, the cording 5 is thread adhered in the seam at the center of the top back corners of panels 3, thread adhered in the center of the back seam sides of panel 2, and thread adhered in the center of the side back corners of panel 4. Each panel individually has their own means for being secured to the highchair whereby the panels may be individually used or removed. The cording being of a sufficient length to allow for the highchair/feeding chair booster cushion to be anchorable on the specific model highchair/feeding chair. Any means for removably securing the highchair/feeding chair booster cushion to the highchair/feeding chair may be used, including snap fasteners, Velcro, or other means. Also, the cording 5 can be used as a personal option to tie panel 2 and panels 3 to each other and then to the highchair/feeding chair.

The booster cushion also comprises of two interchangeable side panels 3, one bottom panel 4 and one back panel 2 of a vinyl fabric 1*a* sewn together with thread to form a cover over foam rubber 1*b*of a single density. This invention contemplates any such means of covering material, filling material and adhering material. In this embodiment, side panels 3 edges are located adjacent lateral edges of the bottom panel 4 and back panel 2, and a rear edge of the bottom panel 4 is adjacent a lower edge of the back panel 2. The panels are joined by thread adhered detachable elongated strip fastening 6*a* and 6*b*, cooperating surfaces facing each other with one said surface carrying a plurality of small hook like members 6*a* and the other said surface carrying a felt-like material 6*b*, said surfaces engageable with each other; will be located in the center on the bottom of panel 2 and panels 3, and located in the center on the outer edges on the top of panel 4 back and side portions. This detachable elongated strip fastening 6*a* and 6*b* is the means for quick and easy assembly and disassembly of the seat panel to the back panel and the side panels to the seat panel forming the structure and whereby enabling the back panel 2 and side panels 3 to be flush with the bottom panel 4. This invention contemplates any such means for attaching the detachable elongated strip fastening including, glue, rivets, or other means. Said detachable elongated strip fastening being of a sufficient length to allow for the panels to be secure. Any means for removably attaching panel 2, panels 3 and panel 4 to each other may be used, including snap fasteners, tie strings or other means.

In order to utilize the safety straps easily that are already a standard part of most highchair/feeding chairs, panel 2 and panels 3 are constructed with fastening only on the bottom panel edges.

Highchair/feeding chair models vary somewhat in dimensions, this invention contemplates any dimensions highchair/feeding chair booster cushion.

In order for each child to be properly fitted to his/her highchair/feeding chair the highchair/feeding chair booster cushion must be manufactured in various widths, this invention contemplates any width highchair/feeding chair booster cushion. Being that all the panels will be manufactured in various widths, a person will be able to interchange each of these panels for smaller widths of the same panel section if the child still needs the support of that section but not in that width. In some cases, a child may need a larger panel section, this will also be possible.

All embodiments of this invention would function to fit each individual child to his/her highchair/feeding chair.

I claim:

1. A highchair booster cushion for sizing a highchair to a child comprising:

a. a back panel, two interchangeable side panels and a seat panel, said panels being formed of a pliable material covered by a vinyl resin incorporated material b. elongated strip fastening means, said elongated strip fastening means is located on a top surface of the seat panel at outermost edges of a rear position and two side portions, complimentary elongated fastening means located at the bottom of the back panel, and at the bottom of both side panels, whereby the elongated strip fastening means provides for a flush disengagable mounting between the seat panel to the back panel and both side panels c. means for securing said highchair booster cushion to the highchair as to allow for the structure to be anchored on the highchair; said seat panel, back panel and both side panels individually have their own means for securing to the highchair whereby the seat panel, back panel and both of the side panels may be individually used or removed.

* * * * *